US006814150B2

(12) United States Patent
Clauss et al.

(10) Patent No.: US 6,814,150 B2
(45) Date of Patent: Nov. 9, 2004

(54) DYNAMIC FIRE-EXTINGUISHING SYSTEM

(75) Inventors: Torsten Clauss, Heidestrasse 55, D-10551 Berlin (DE); Andreas Schmidt, Bestensee (DE); Wassili Jansen, Berlin (DE)

(73) Assignee: Torsten Clauss, Berlin (DE)

( * ) Notice: Subject to any disclaimer, the term of this patent is extended or adjusted under 35 U.S.C. 154(b) by 0 days.

(21) Appl. No.: 10/204,964

(22) PCT Filed: Feb. 27, 2001

(86) PCT No.: PCT/DE01/00811

§ 371 (c)(1),
(2), (4) Date: Aug. 26, 2002

(87) PCT Pub. No.: WO01/64288

PCT Pub. Date: Sep. 7, 2001

(65) Prior Publication Data

US 2003/0029622 A1 Feb. 13, 2003

(30) Foreign Application Priority Data

Feb. 29, 2000 (DE) ..... 100 10 881

(51) Int. Cl.[7] ..... A62C 2/00; A62C 35/00; A62C 37/09; A62C 37/11; B04B 1/02

(52) U.S. Cl. ..... 169/7; 169/37; 169/46; 169/60; 239/11; 239/451; 239/456; 239/470; 239/480

(58) Field of Search ..... 169/7, 37, 46, 169/50; 239/11, 419, 451, 456, 469, 470, 479, 480, 481, 493

(56) References Cited

U.S. PATENT DOCUMENTS

| | | | | |
|---|---|---|---|---|
| 2,520,824 A | * | 8/1950 | Barton | 239/480 |
| 2,531,789 A | * | 11/1950 | Rowley | 239/475 |
| 2,567,642 A | | 9/1951 | Henshaw | |
| 3,282,511 A | * | 11/1966 | Barton | 239/480 |
| 3,934,463 A | | 1/1976 | Venderjagt | |
| 4,872,511 A | * | 10/1989 | Davis | 169/46 |
| 5,067,655 A | * | 11/1991 | Farago et al. | 239/493 |
| 5,505,383 A | | 4/1996 | Fischer | 239/518 |
| 6,104,301 A | * | 8/2000 | Golden | 169/60 |

FOREIGN PATENT DOCUMENTS

| | | |
|---|---|---|
| DE | 969 426 | 6/1958 |
| DE | 27 03 459 | 8/1977 |
| DE | 29 24 654 | 2/1981 |
| DE | 36 24 939 | 1/1988 |
| DE | 100 10 881 | 9/2001 |
| EP | 0 505 672 | 9/1992 |
| EP | 0 671 216 | 9/1995 |

* cited by examiner

*Primary Examiner*—John J. Vrablik
(74) *Attorney, Agent, or Firm*—Herbert Dubno; Andrew Wilford

(57) ABSTRACT

The invention relates to a method and a device for distributing liquid media, in particular extinguishing fluids for fighting fires, in the form of a mist or a stream of large droplets from a supply line which is maintained at a constant low-pressure, in rooms, for example in living spaces and recreation rooms, or similar. The aim of the invention is to provide a method and a device of the aforementioned type which can be used to produce a fine mist of small droplets and a jet spray of large droplets at separate moments, at approximately the same operating pressure of the extinguishing fluid, depending on the outbreak and the development of the fire, whilst at the same time minimising water consumption, reducing water damage caused during a fire and increasing cost-effectiveness, by creating a modular system which can be universally installed. To achieve this, the intensity of the vortex and the proportion of fine or large droplets in the spray cone is adjusted by regulating the quantity and speed of the flow of the sub-streams of extinguishing fluid, either separately or synchronously between a zero value and a maximum throughput value. In addition, the adjusting process is controlled by a signal generator which responds to the outbreak and dynamic development of the fire.

21 Claims, 4 Drawing Sheets

DYNAMIC FIRE-EXTINGUISHING SYSTEM

CROSS REFERENCE TO RELATED APPLICATIONS

This application is the U.S. national phase of PCT application PCT/DE01/00811 filed Feb. 27, 2001 with a claim to the priority of German application 100 10 881.4 filed 29 Feb. 2000.

FIELD OF THE INVENTION

The invention relates to a method of distributing liquid media, in particular extinguishing liquids like water or the like in the form of a mist or a large-droplet stream from a low-pressure supply line into spaces, in particular living or household rooms or the like to fight fire where the pressurized extinguishing liquid is made into individual streams and these streams are separately set in rotation and subsequently the streams are combined to form a spray cone.

The invention further relates to an apparatus for carrying out the above-described method with a support on which is provided a fitting for connection to a low-pressure supply line, a connection body, and a turbulence chamber surrounding the connection body, the turbulence chamber being traversed by separate streams of the extinguishing liquid.

BACKGROUND OF THE INVENTION

Sprinkler for applying extinguishing liquids in stationary fire-extinguishing systems have been known for long. German 2,703,459 describes a sprinkler nozzle for upright, horizontal, and pendant mounting with a nozzle body and an impingement plate that is connected with the nozzle body with at least two support elements fixed to an edge of the impingement plate as well as an arrangement which blocks the nozzle opening of the sprinkler nozzle on manufacture and which is formed of a closure element sealing the nozzle opening and a release element pressing against the later but which can release its force on the closure element and allow the extinguishing-water stream to exit. The closure element is provided with an ejector which, when the retaining force is released, works with the force of the extinguishing water, the ejector being fixed to the joined parts of the sprinkler head when same is in standby condition.

German 2,924,654 describes a sprinkler for automatic fire-extinguishing systems, which is comprised of a housing defining a flow passage for the extinguishing liquid, a two-arm frame on the housing carrying a distributor cap, a cover cap closing the flow passage, and an assembly between the two caps which has a lever, a support strut with two laterally perforated tabs, and a temperature monitor set between the tabs. The support strut has a projecting antijam arm whose longitudinally bent main portion extends generally parallel to the struts and which on sprinkler activation engages against the frame and distributor cap.

Other solutions (EP 0,505,762, U.S. Pat. No. 3,834,463, or U.S. Pat. No. 5,505,383) serve mainly for applying a large-droplet spray of the extinguishing agent in nearly constant amounts over time, because on one hand the diameters of the outlet openings of the sprinklers is fixed and on the other hand the extinguishing-media pressure in the supply line is constant. This leads in a fire mainly to usage of a great deal of water by the stationary extinguishing system with all the inherent disadvantages of overdimensioning the pumps, pipes, and storage containers for extinguishing media in the system.

The sprinkler nozzle described in German 3,624,939 produces a spray stream that has small and large droplets, more particularly small drops in a relatively small edge area and large drops in a central area. This is done in that the outlet opening or the outlet openings are downstream of inlet openings whose flow cross section is somewhat smaller than the flow cross section of the outlet opening or openings.

A spray nozzle for producing a mist with low pressure, in particular to fight fire in stationary water-mist fire-extinguishing systems is known from EP 0,671,216. This known nozzle is built radially into a pipe of a fire-extinguishing system and is comprises of a housing holding a flow body that traversed by a conically tapering turbulence/mixing chamber. The surface of this turbulence/mixing chamber is formed with spiral grooves with axial inlets that communicate with inlet openings for the water. An annular space permits a further stream of water into the inner turbulence/mixing chamber. There is thus stream separation. The one path leads via the inlet openings and the twist passages to cylindrical nozzle openings and there produces and inner spray cone. The second path extends via the annular chamber and tangential bores to an annular gap from which the water exits as an outer spray cone.

The known solution serves mainly for applying a large-droplet inner spray stream and a fine-droplet outer spray stream. It is not possible to obtain an initial fine-drop spray mist when the fire starts and a large-droplet spray mist when the fire is under way to apply the extinguishing media. All of the above-cited disadvantages of the state of the art have nothing to do with this known solution.

OBJECTS OF THE INVENTION

Starting from this state of the art it is an object of the invention to provide a method and apparatus of the above-described type by means of which it is possible with nearly constant supply pressure of the extinguishing means to, with time, in accordance with the whether the fire has just started or is under way to apply a fine-droplet spray mist and a large-droplet spray mist so as to minimize water use, reduce water damages in fire, and to increase the efficiency of the fire-extinguishing system in any installation.

SUMMARY OF THE INVENTION

This object is attained by a method and an apparatus of the above-described type wherein the turbulence intensity and the ratio of small and large droplets in the spray are adjusted between zero and a maximal value by adjustment of the flow volume and the flow speed of streams of the extinguishing liquid either separately or synchronously and that the adjustment is controlled by a signal generator after a fire starts dynamically in accordance with the development of the fire.

The invention is characterized above all by its simplicity and is particularly applicable to wet systems. In contrast to the known state of the art a simple flow regulation in the separated and rejoined streams of the extinguishing fluid produces an excellent influencing of the turbulence intensity in dependency of whether the fire has just started or is underway. When the streams are produced it is further possible to impinge small and large surfaces of an object to be protected with spray cones and spray streams of different shape and composition. According to the above-given requirements as a fire starts up the apparatus according to the invention produces at first a mist like droplet stream. The signal generator can in this case be a smoke detector. As the fire develops a large-droplet spray stream is needed so a further detector, for instance a heat detector, produces a signal which acts on the adjuster of the apparatus in that the flow cross section of the opening of the slot is enlarged.

The solution according to the invention reduces water use to fight a fire substantially and simultaneously reduces water damage caused by the unregulated outflowing of the extinguishing medium. The fire-extinguishing systems can be better tailored to the dynamics of the fire as it starts and develops.

BRIEF DESCRIPTION OF THE DRAWING

Further advantages and details of the invention are more closely described below with reference to a specific embodiment. Therein.

SPECIFIC DESCRIPTION

Figure 1:
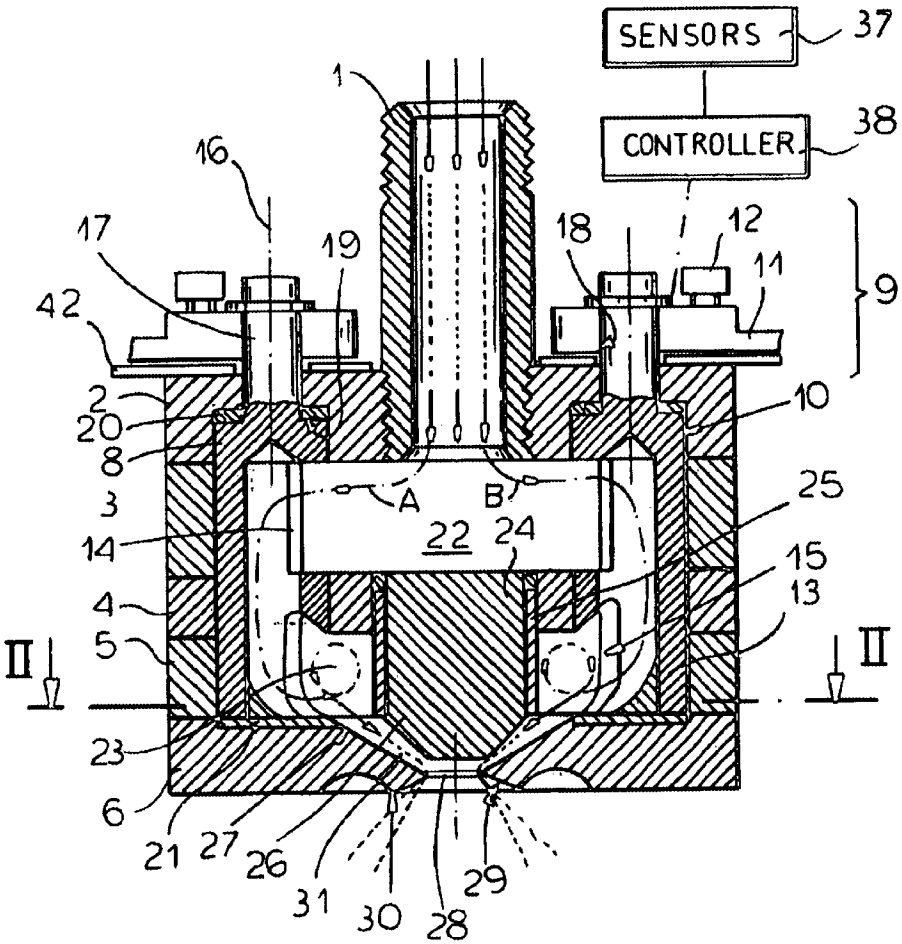
FIG. 1 is a side sectional view of the apparatus according to the invention, the stream flow being shown

The apparatus according to the invention is comprised as shown in FIG. 1 of a support body provided with an inlet fitting 1 and itself formed of a top plate 2, a distributing-chamber ring 3, a spacer plate 4, a turbulence-chamber ring 5, and an outlet plate 6, all secured by unillustrated screws in bolt holes 7 extending through all the plates and rings. The inlet 1 is screwed centrally into the top plate 2. The top plate 2 and the spacer plate 4 form passages 8 adjustable by respective adjuster or adjustment means 9.

Figure 2:
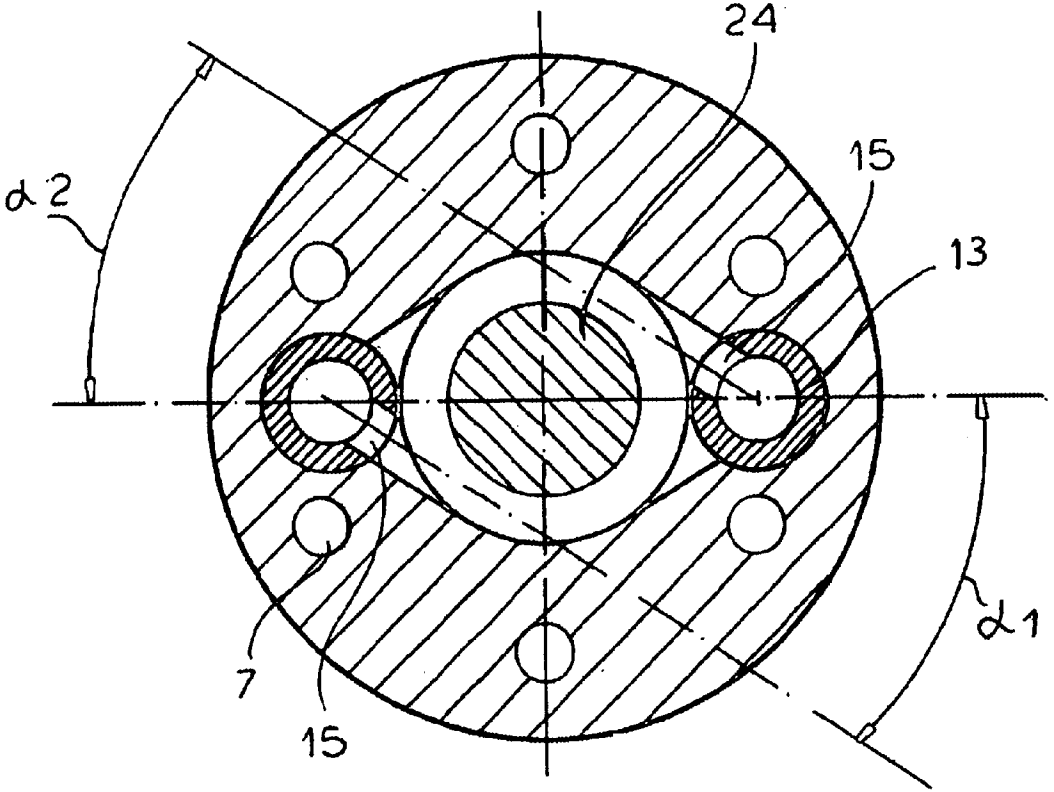
FIG. 2 is a section taken along line II—II of FIG. 1.

The adjusters 9 are each comprised of a hollow sleeve-like body 10 closed at both ends, an adjustment arm 11 coupled with the hollow body 10 and a brake mechanism 12. A wall 13 of each hollow body 10 is formed with two axially aligned slot openings 14 and 15 (see FIGS. 2 and 3). The hollow body 10 has on its upstream end near the inlet 1 a pin 17 defining an axis 16 and extending out through a hole 18 in the top plate 2. The pin 17 carries the adjustment arm 11 which can be fixed angularly by the brake mechanism 12.

Figure 3:
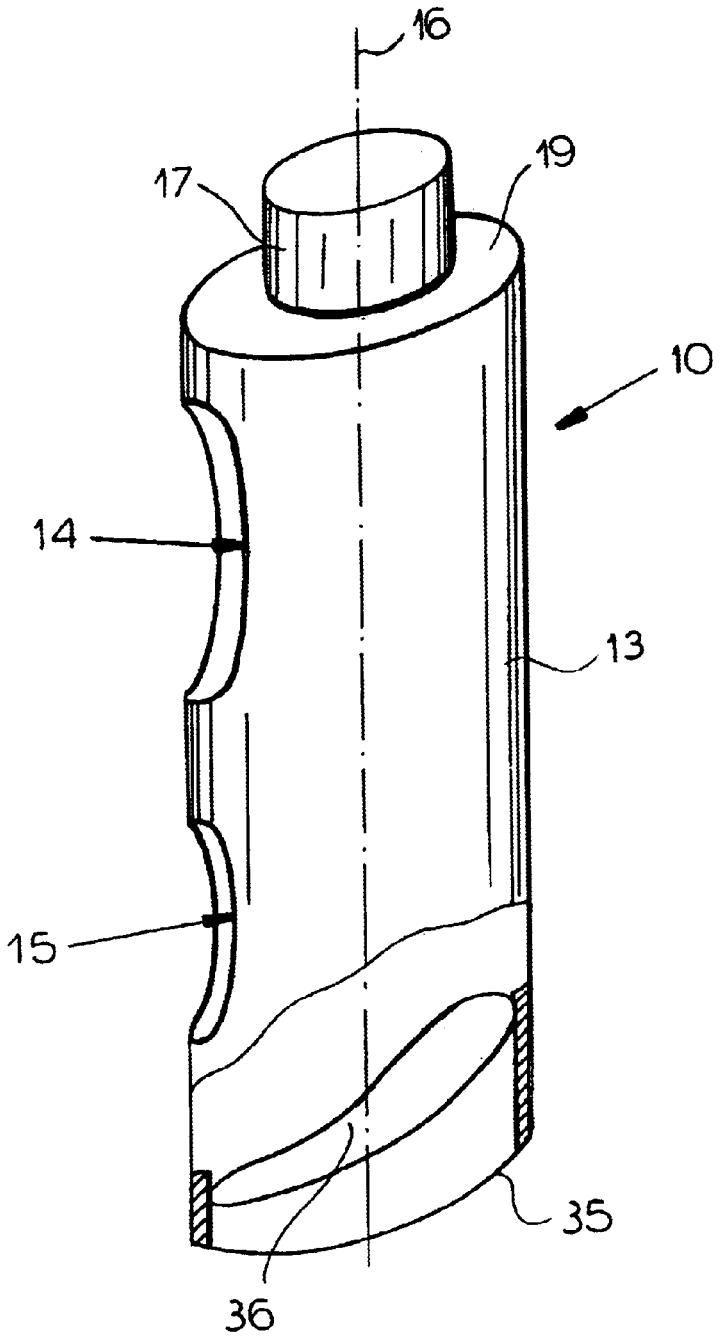
FIG. 3 is a perspective view of the housing.

The distributing-chamber ring 3 and the turbulence-chamber ring 5 are of the same axial heights as the respective slots 14 and 15. FIG. 3 shows the position of the slots 14 and 15 of the hollow body 10 in perspective. In this embodiment the hollow body 10 is fitted with a plug-like insert 35 which is internally formed as a flow deflector with an angled upper surface 36.

The pin 17 is in this embodiment of somewhat smaller diameter than the hollow body 10 so that the hollow body 10 has a shoulder 19 on which sits a seal ring 20 that supports and seals the hollow body 10 with respect to the top plate 2. The hollow body 10 thus passes through the distributing-chamber ring 3, the spacer plate 4, and the turbulence-chamber ring 5 and sits on a seal/bearing disk 21 seated in the outlet plate 6. On rotation of the pin 17 about the hollow-body axis 16 the angular positions of the slots 14 changes relative to a distributing chamber 22 formed by the distributing-chamber ring 3 as does the flow cross section of the slot 14. The flow cross section of the slot openings 15 into a turbulence chamber 23 is similarly changed.

Axially centered on the inlet in the spacer plate 4 is a cylindrical closure body 24, screw-mounted so as to be vertically axially adjustable. This is done by simply providing a snap ring 25. The closure body 24 has a frustoconical head 26 that extends into a funnel-shaped opening 27 of the output plate 6 that is flared into the turbulence chamber 23 and ends in an outlet opening 28 formed with an outlet flare 29 ending at a separation edge 30. The outlet flare 29 can be of frustoconical or other shape. The head 26 and opening 27 form a funnel-shaped passage 31 whose flow cross section can be changed by adjusting the height of the closure body 24.

The water admitted by the inlet 1 is subdivided as shown in FIG. 1 in the distributing chamber 22 into two streams A and B. The two streams A and B pass through the slots 14 of both adjusters 9 and are deflected down through the hollow bodies 10 to exit therefrom through the slots 15 tangentially into the turbulence chamber 23 where they mix turbulently together and are then fed to the funnel-shaped outlet passage 31. The two combined streams exit through the outlet opening 28 of the outlet plate 6.

According to how the adjusters 9 are set, the sizes of the flow cross sections of the slots 14 and 15 vary, as does the amount of turbulence in the joined streams A and B between minimal and maximal values. On changing the adjustment angle $\alpha 1$ and/or $\alpha 2$ by means of the adjusters 9 the water-flow speed changes in the slots 15 presuming constant water pressure (see FIG. 2). An increase of the angles $\alpha 1$ or $\alpha 2$ or of both simultaneously decreases the effective size of the slot 15 and correspondingly increases the flow speed and thus the misting ability of the water. In this case there is a spray with mainly fine droplets that is in particular useful at the start of a fire. A decrease of the angle $\alpha 1$ or $\alpha 2$ or of both simultaneously decreases the water rotation and the flows work against each other. In this case there is a spray that is mainly large droplets.

If the adjuster 9 is turned so far that the slits 15 are closed relative to the turbulence chamber 23, no more flow is possible. The invention is therefore in standby condition.

Figure 4B:
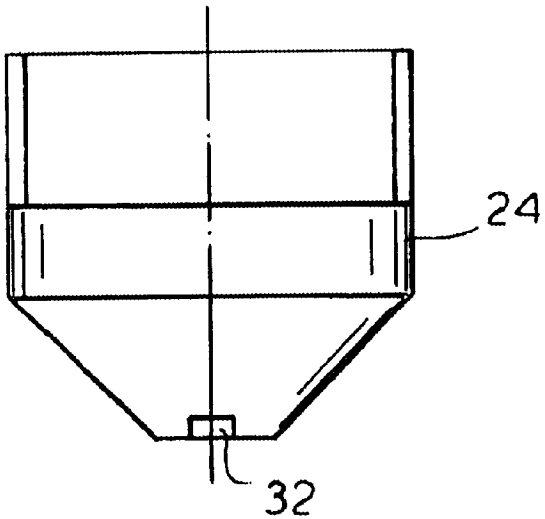
FIGS. 4*a* and 4*b* are side views of two nozzles according to the invention.
Figure 4A:
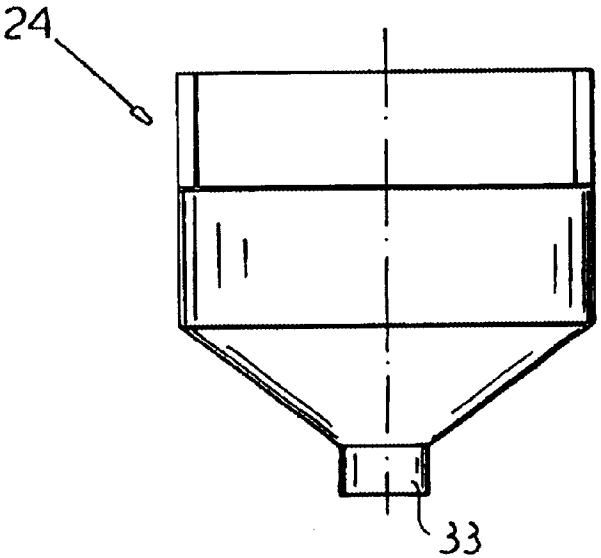

FIG. 4*b* shows the closure body 24, which has slit-shaped cutouts 32 in its frustoconical head 26. The body 24 of FIG. 4*a* has a profiling 33 that is turned toward the flow passage 31 or which extends thereinto. The cutout 32 or the profiling 33 increases the turbulence of the moving water.

As a result of the adjustability of the free flow cross sections of the slots from outside it is possible to control or adjust in accordance with the dynamics of a fire. Signals obtained from sensors or signal generator 33, here smoke and heat detectors, indicating a fire that is just starting or in progress are translated by a controller 34 into adjustment signals for the adjusters 9 and the nozzle according to the invention can react dynamically as the fire develops.

What is claimed is:

1. A method of extinguishing a fire in a living space with a liquid with use of a nozzle capable of producing a fine-droplet mist spray and a large-droplet soak spray, the method comprising the steps of:

automatically monitoring conditions inside the living space to detect if a fire is present and, if a fire is present, whether the fire has just started or is established;

on nondetection of a fire, blocking liquid flow from the nozzle;

on detection of the start of a fire, operating the nozzle to produce the fine-droplet mist spray; and on detection of an established fire, operating the nozzle to produce the large-droplet soak spray.

2. The fire-extinguishing method defined in claim 1 wherein conditions are monitored by detecting ionized smoke particles, optically detecting smoke, monitoring temperature, or detecting flame.

3. The fire-extinguishing method defined in claim 1 wherein the start of the fire is detected by a smoke detector and the established fire is detected by a heat detector.

4. A system for extinguishing a fire in a living space, with a liquid, the system comprising:

a nozzle operable to producing a fine-droplet mist spray and a large-droplet soak spray;

sensor means for automatically monitoring conditions inside a living space to detect if a fire is present and, if a fire is present, whether the fire has just started or is established; and control means connected to the sensor means for, on nondetection of a fire, blocking liquid flow from the nozzle, on detection of the start of a fire, operating the nozzle to produce the fine-droplet mist spray, and on detection of an established fire, operating the nozzle to produce the large-droplet soak spray.

5. The fire-extinguishing system defined in claim 4 wherein the nozzle comprises:

a housing forming a distributing chamber and a turbulence chamber having an outlet, a closure body in the outlet and normally defining in the outlet an outlet passage from the turbulence chamber;

means including an inlet for feeding the liquid under continuous low pressure to the distributing chamber; and adjustment means connected to the control means and including a valve body in the housing between the distributing chamber and the turbulence chamber for varying flow of the liquid from the distributing into the turbulence chamber.

6. The fire-extinguishing system defined in claim 5 wherein the closure body is tapered toward the turbulence chamber.

7. The fire-extinguishing system defined in claim 5, further comprising means for displacing the closure body relative to the housing and thereby varying a flow cross section of the outlet passage.

8. The fire-extinguishing system defined in claim 5 wherein the valve body is a sleeve having upstream and downstream openings respectively opening into the distributing and turbulence chambers, the adjustment means including means for pivoting the sleeve and thereby covering and uncovering the openings.

9. The fire-extinguishing system defined in claim 8 wherein the housing is formed by an outlet plate centrally formed with the outlet;

a turbulence-chamber ring forming the turbulence chamber and sitting on the outlet plate;

a spacer plate sitting on the turbulence-chamber ring;

a distributing-chamber ring sitting on the spacer plate and forming the distributing chamber;

an inlet top plate sitting the distributing-chamber ring and carrying the inlet; and bolts connecting the plates and rings together.

10. The fire-extinguishing system defined in claim 9 wherein the sleeve has an end at the turbulence chamber provided adjacent the downstream opening with an angled flow deflector.

11. The fire-extinguishing system defined in claim 9 wherein the rings and spacer plate are formed with a bore rotatably receiving the sleeve.

12. The fire-extinguishing system defined in claim 11 wherein the sleeve has an end pin projecting from the housing and connected to the control means.

13. The fire-extinguishing system defined in claim 12, further comprising a seal between the end pin and the housing.

14. The fire-extinguishing system defined in claim 12 wherein the end pin is of smaller diameter than the sleeve.

15. The fire-extinguishing system defined in claim 5 wherein the closure body and outlet form a funnel-shaped opening.

16. The fire-extinguishing system defined in claim 15 wherein the outlet is formed with an outlet flare and separation edge.

17. The fire-extinguishing system defined in claim 16 wherein the flare is frustoconical.

18. The fire-extinguishing system defined in claim 5 wherein the closure body has flow-directing surface formations.

19. The fire-extinguishing system defined in claim 18 wherein the formations include a slot formed in the closure body.

20. A method of extinguishing a fire in a living space with use of a nozzle capable of producing streams of liquid, rotating the streams, and bringing the streams together to form a spray cone, the method comprising the steps of:

detecting development of a fire in the space with sensors; and dynamically regulating the rate of flow of the streams and the velocity of flow of the streams separately to change the ratio of small and large droplets in the spray as the fire develops.

21. An apparatus for extinguishing a fire in a space with a liquid, the apparatus comprising:

a housing connected to a low-pressure supply of the liquid and defining a distributing chamber and a turbulence chamber;

a closure body in the distributing chamber forming therein a pair of streams of the liquid;

respective regulating bodies between the chambers defining inlets opening into the distributing chamber and receiving the respective streams and outlets opening into the turbulence chamber and feeding the respective streams thereinto, the bodies being operable to vary cross sections of the respective inlets and outlets; and control means including fire sensors connected to the regulating bodies for detecting a fire in the space and operating the bodies.

* * * * *